US006229416B1

(12) United States Patent
Ebihara et al.

(10) Patent No.: US 6,229,416 B1
(45) Date of Patent: May 8, 2001

(54) MAGNETIC SWITCH FOR STARTER USED IN INTERNAL COMBUSTION ENGINE

(75) Inventors: Koohei Ebihara, Hitachinaka; Tamotsu Tokita, Naka-machi, both of (JP)

(73) Assignees: Hitachi, Ltd., Tokyo; Hitachi Car Engineering Co., Ltd., Hitachinaka, both of (JP)

( * ) Notice: Subject to any disclaimer, the term of this patent is extended or adjusted under 35 U.S.C. 154(b) by 0 days.

(21) Appl. No.: 09/628,671

(22) Filed: Jul. 28, 2000

(30) Foreign Application Priority Data

Jul. 29, 1999 (JP) ..... 11-214621

(51) Int. Cl.[7] ..... H01H 67/02
(52) U.S. Cl. ..... 335/131; 335/127; 335/156
(58) Field of Search ..... 335/106, 126, 335/127, 131, 156, 281; 290/36 R, 38 R, 38 A, 38 C, 46, 47, 48, 281, 282

(56) References Cited

U.S. PATENT DOCUMENTS

| | | | | |
|---|---|---|---|---|
| 4,251,788 | * | 2/1981 | Barthruff et al. | 335/157 |
| 4,801,909 | * | 1/1989 | Fasola | 335/126 |
| 5,256,992 | | 10/1993 | Fasola et al. | 335/126 |
| 5,757,256 | | 5/1998 | Vilou | 335/126 |
| 5,973,581 | * | 10/1999 | Jacquin et al. | 335/131 |

FOREIGN PATENT DOCUMENTS

| | | |
|---|---|---|
| 4-337223 | 11/1992 | (JP) . |
| 7-253072 | 3/1995 | (JP) . |
| 11-030169 | 2/1999 | (JP) . |

* cited by examiner

*Primary Examiner*—Ray Barrera
(74) *Attorney, Agent, or Firm*—Evenson, McKeown, Edwards & Lenahan, P.L.L.C.

(57) ABSTRACT

In a magnetic switch for a starter, an impact force due to return force of a contact pressing coil spring 25 for a plate shaped movable contact 19 is received by a collar 18*a* formed integral with a movable non-magnetic shaft 18, and an insulative spring stopper member 22 having a cylindrical portion 22*a* is disposed beneath the contact pressing coil spring concentrically therewith in an overlapping manner along the movable non-magnetic shaft. A hollow cylindrical coil 14 is secured by a casing side plate 16 of a casing 15 and another side plate 17 having a tapered cylindrical protrusion 17*a* in axial and radial directions with respect to a magnetic core including the side plates 16, 17 and the casing 15. When the movable non-magnetic shaft is an insulative material, the plate shaped movable contact 19 and the contact pressing coil spring 25 are assembled only with the insulative spring stopper member 22, and when the movable non-magnetic shaft 18 is an electrically conductive material, the plate shaped movable contact 19 and the contact pressing coil spring 25 are assembled with the insulative spring stopper member 22 and an insulative washer or bush 23, 24. Thereby, a reliable small size magnetic switch for a starter with a simplified structure can be realized which easily ensures the strength of an impact force receiving portion provided on the movable non-magnetic shaft 18 and endures a large vibration, and of which parts number, manufacturing steps and manufacturing cost are as well reduced.

9 Claims, 4 Drawing Sheets

MAGNETIC SWITCH FOR STARTER USED IN INTERNAL COMBUSTION ENGINE

BACKGROUND OF THE INVENTION

1. Field of the Invention

The present invention relates to a magnetic switch for a starter used in an internal combustion engine, and in particular, relates to an improvement in a structure of a magnetic switch for a starter including an electromagnet having a hollow cylindrical coil which controls the current supply between a battery and a starter motor.

2. Conventional Art

As an example of conventional structures of magnetic switches for starters, U.S. Pat. No. 5,256,992 discloses a magnetic switch in which a rectangular plate shaped movable contact is disposed on a movable control rod between an annular collar shaped head at the end thereof and a helical spring arranged around the rod, while interposing at the respective faces of the plate shaped movable contact a pair of an insulative washer and an insulative bush having a protrusion, and the other end of the helical spring is supported by a guide sleeve fixed to the other end of the rod.

Further, U.S. Pat. No. 5,757,256 discloses another example in which a rectangular plate shaped movable contact is disposed on a presumably insulative movable control rod between a constant spring and a metal washer fixed axially on the rod against a tapered shoulder thereof by a clawed metal washer at the axial end of the control rod, and the other end of the constant spring is supported by another shoulder formed integrally on the control rod.

Still further, JP-A-4-337223(1992), JP-A-07-253072 (1995) and JP-A-11-30169(1999) discloses still other examples in which a rectangular plate shaped movable contact is disposed on an electrically conductive movable shaft between a movable contact holding member fixed at an end thereof and a contact pushing spring, while interposing at the respective faces of the plate shaped movable contact a pair of an insulative washer and an insulative bush having a protrusion for insulating the movable contact from the movable shaft, and the other end of the contact pushing spring is supported by an annular collar formed integrally on the movable shaft.

Further, in the above examples an inner stationary core forming a magnetic flux passage together with a casing thereof for a hollow cylindrical coil is usually formed through cold forging to have a cylindrical protrusion so as to secure the hollow cylindrical coil at the circumference thereof together with the casing and to permit axial movement of the movable rod or shaft of non-magnetic material, therefore, an elastic member such as a leaf spring is interposed between the side face of the casing and the hollow cylindrical coil so as to prevent vibration of the hollow cylindrical coil with respect to the casing.

With the structure including the fitting member secured to the shaft and/or shaft end caulking and for receiving an impact force of the plate shaped movable contact which is caused when recovering compressed distance of the contact pressing spring corresponding to over travelling of the rod immediately after being released from activation or deenergization of the magnetic switches for the starters as has been explained above, it was difficult to adjust the grip strength of the fitting member and the caulking strength at the shaft top end which can endure the repeating impact force from the plate shaped movable contact as well as it took time for the adjustment. On the other hand, the structure which receives the impact force with the collar formed integral with the shaft satisfies a required mechanical strength, however, since a spring stopper has to be provided at he remote side of the contact pressing spring from he movable contact along the shaft, while interposing intermediate members at respective faces of the movable contact plate, the total length of the shaft carrying the movable contact is prolonged as well as the diameter of the shaft receiving through hole in the inner stationary core cylindrical protrusion has to be enlarged which reduces the cross sectional area of the magnetic flux passage circuit in the stationary magnetic core, or otherwise enlarges the radial size of the stationary magnetic core. Moreover, in the conventional structure, in order to fixedly secure the hollow cylindrical coil in the casing together with the inner stationary core, such as a leaf spring has to be interposed between the hollow cylindrical coil and the side face of the casing, which causes an increase of parts number and assembly manhour to increase the manufacturing cost thereof.

SUMMARY OF THE INVENTION.

An object of the present invention is to provide a highly reliable magnetic switch for a starter used in an internal combustion engine of which structure is simplified and of which size, parts number, assembly manhour as well as manufacturing cost are reduced.

According to the present invention, a movable contact plate is directly sandwiched and held by a collar formed integral with a shaft and a contact pressing spring, an impact force of the movable contact plate caused by the contact pressing spring when the compressed amount of the contact pressing spring corresponding to the over travelling distance after being released from the activation of the magnetic switch is received by a collar formed integral with the shaft, and a cylindrical portion of an insulative spring stopper member is inserted along the movable shaft inside the contact pressing coil spring in concentric and overlapping manner therewith, in other words, in coaxial and overlapping manner therewith. When the shaft having the integrally formed collar which receives and stops the movable contact plate is made of an insulative material, the movable contact plate and the contact pressing coil spring are simply assembled together only with the insulative spring stopper member having the cylindrical portion which is to be inserted inside the contact pressing coil spring along the shaft, further, when the shaft having the integrally formed collar which receives and stops the movable contact plate is made of an electrically conductive material, the movable contact plate and the contact pressing coil spring are also easily assembled together with the insulative spring stopper member and a set of insulative washers (or bushes). Still further, a hollow cylindrical coil is sandwiched and held in both axial and radial directions by the side plate of the casing and the side plate stationary core having a tapered protrusion which is formed by a sheet metal pressing of simple manufacturing processes so as to constitute a unitary body of the hollow cylindrical coil and the casing.

With the above structure, even if the degrees of the parts accuracy and of the strength adjustment of the assembly are reduced, a predetermined strength necessary for enduring the impact force due to the contact pressing coil spring can easily be ensured with the collar formed integral with the shaft, further, since the contact pressing coil spring and the cylindrical portion of the insulative spring stopper member are disposed in concentric and overlapping manner along the shaft, the total length of the shaft as well as the outer diameter of magnetic core formed by the casing and the inner stationary core are reduced, thereby, a necessary cross sectional area for the magnetic flux passage circuit can be realized with a small size magnetic core. Further, since the hollow cylindrical coil is firmly secured in the casing by the tapered protrusion outer circumference of the inner stationary core without using parts such as leaf springs within the casing in the axial and radial directions thereof, a possible movement of the hollow cylindrical coil with respect to the casing is substantially suppressed to thereby endure a possible large vibration.

DETAILED DESCRIPTION OF THE PREFERRED EMBODIMENTS

Hereinbelow embodiments of the present invention will be explained with reference to the drawings.

Figure 1:
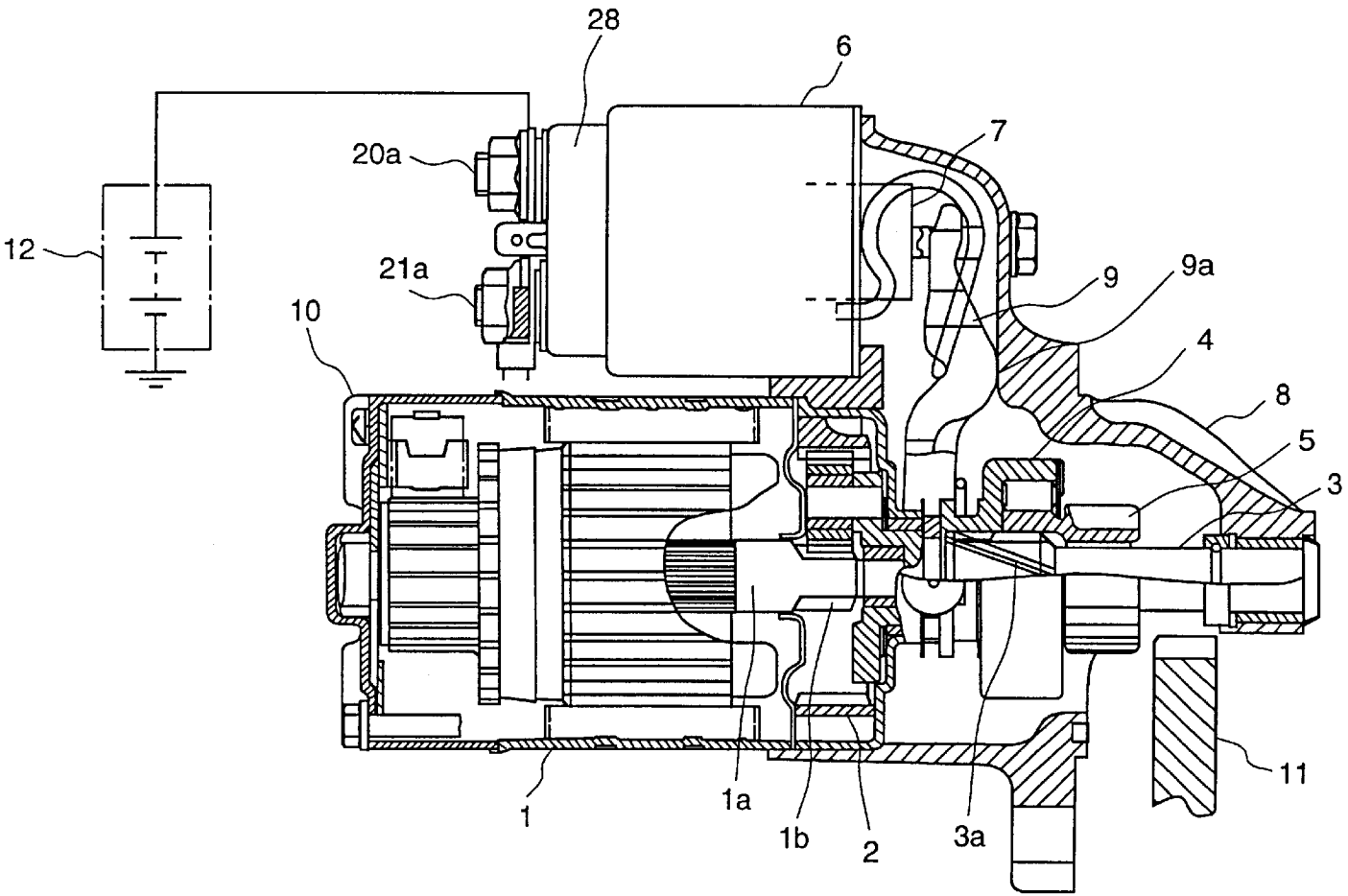
FIG. 1 is a partly cross sectioned side view of a starter used in an internal combustion engine with a magnetic switch therefor to which the present invention is applied.

FIG. 1 shows a partly cross sectioned side view of a starter with a magnetic switch to which the present invention is applied. One end of a motor shaft 1*a* at the center of a starter motor 1 is supported by a rear cover 10 and the other end of the motor shaft 1*a* where a shaft gear 1*b* is provided is directly coupled with a reduction gear device 2. A pinion shaft 3 serving as an output shaft of the reduction gear device 2 is provided with a helical spline 3*a* around a part of the outer circumference thereof, and one end of which is supported at a gear casing 8, a roller clutch 4 assembled together with a pinion 5 is engaged with the helical spline 3*a* and the roller clutch 4 and the pinion 5 are permitted to move on the pinion shaft 3 in the axial direction thereof and transmit rotating force of the starter motor 1 to an internal combustion engine (not shown).

One end of a shift lever 9 is coupled to the roller clutch 4 and the other end thereof is coupled to a plunger 7 of a magnetic switch 6. Through an axial movement of the plunger 7 the shift lever 9 is rotated around a supporting point 9*a* to move the roller clutch 4 and the pinion 5 on the pinion shaft 3 so as to engage the pinion 5 with a ring gear 11 directly coupled to the internal combustion engine.

The magnetic switch 6 is assembled together with the plunger 7 arranged at one end thereof and an insulative contact casing 28 secured at the other end including a terminal bolt 20*a* directly connected to a battery and another terminal bolt 21*a* directly connected to the starter motor 1.

Figure 2:
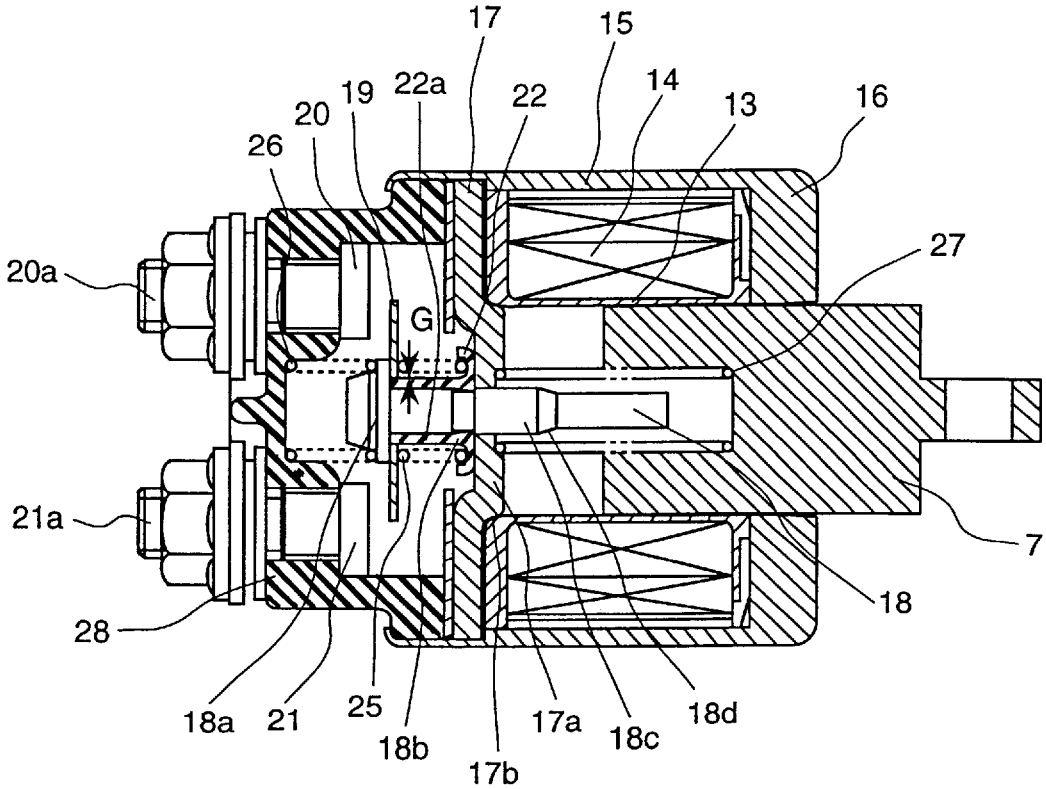
FIG. 2 is a cross sectional view of a magnetic switch representing an embodiment according to the present invention.
Figure 3:
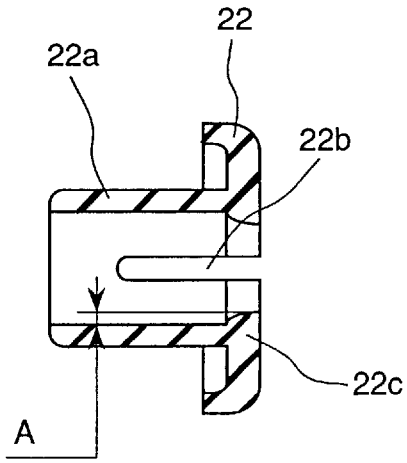
FIG. 3 is a detailed cross sectional view of an insulative spring stopper member used in the embodiment as shown in FIG. 2.
Figure 4:
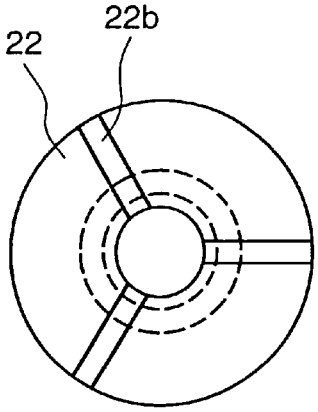
FIG. 4 is a side view of the insulative spring stopper member as shown in FIG. 3.

FIG. 2 is a cross sectional view of a magnetic switch representing an embodiment according to the present invention, FIG. 3 is a cross sectional view of an insulative spring stopper member used in the embodiment and FIG. 4 is a side view of the insulative spring stopper member as shown in FIG. 3. The plunger 7 forms a cylindrical magnetic circuit together with a casing with a side plate 16 and another side plate 17 with a center protrusion 17*a*, and a hollow cylindrical coil 14 formed by winding coils around a bobbin 13 is disposed inside the magnetic circuit. The outer circumference of the center protrusion 17*a* of the side core plate 17 is tapered in such a manner that the outer diameter of the tapered top end of the center protrusion 17*a* is determined smaller than the inner diameter of the bobbin 13 by a predetermined length so as to immovably secure the hollow cylindrical coil 14 in the space defined by the casing 15 and the side core plate 17 having the center protrusion 17*a*. A plunger return spring 27 is disposed between the side core plate 17 and the plunger 7 and returns the plunger 7 to the original position thereof after being released from activation of the magnetic switch 6.

An insulative shaft 18 which is arranged so as to interlock with the movement of the plunger 7 at a predetermined position includes a collar 18*a* formed integrally with the shaft 18, a smaller diameter portion 18*b*, a large diameter portion 18*c* and a tapered shoulder portion 18*d*, an inward step 22*c* formed around the inner circumference of a cylindrical portion 22*a* having a plurality of slits 22*b* provided for the insulative spring stopper member 22 is fitted into the small diameter shaft portion 18*b*, and between the collar 18*a* formed integral with the shaft 18 and the insulative spring stopper member 22 a movable contact plate 19 and a contact pressing coil spring 25 are sandwitched and held. A gap (G) between the outer diameter of the cylindrical portion 22*a* of the insulative spring stopper member 22 and the inner diameter of the contact pressing coil spring 25 is determined larger than the height (A) of the inward step 22*c* formed around the inner circumference of the cylindrical portion 22*a* for the insulative spring stopper member 22 of which importance will be explained later. A contact returning spring 26 is disposed between the contact casing 28 and the shaft 18, in particular, the collar 18*a* of the shaft 18 and works to return the assembly for the movable contact plate 19 to its original position after being released from activation of the magnetic switch.

The movable contact plate 19 faces with a predetermined spacing distance to a B stationary contact 20 having the terminal bolt 20*a* and an M stationary contact 21 having the terminal bolt 21*a* which are integrally secured in the contact casing 28.

Now, the operation of the thus constituted magnetic switch will be explained. When a current is flown to the hollow cylindrical coil 14 in the magnetic switch 6 from the battery 12 through a key switch (not shown), the plunger 7 is pulled in against the spring force of the plunger return spring 27 to move the roller clutch 4 and the pinion 5 over the pinion shaft 3 via the shift lever 9 and to engage the same with the ring gear 11. On the other hand, at the same time the assembly including such as shaft 18 and the movable contact plate 19 is moved against the spring force of the contact return spring 26 through the pull-in of the plunger 7, thus, the movable contact plate 19 is contacted to the B stationary contact 20 and the M stationary contact 21. Even after the movable contact plate 19 has been contacted to the B stationary contact 20 and the M stationary contact 21, the plunger 7 is continuously pulled in and the shaft 18 and the insulative spring stopper member 22 further moves against the contact pressing coil spring 25 by a distance corresponding to the over travelling to form a gap between the collar 18*a* formed integrally with the shaft 18 and the movable contact plate 19, and finally the movement of the shaft 18 is stopped when the plunger 7 hits the protrusion 17*a* of the side core plate 17. At the moment when the movable plate contact 19 contacts to the B stationary contact 20 and the M stationary contact 21, a current flows from the battery 12 to the starter motor 1 and the driving force of the starter motor 1 is transmitted to the reduction gear device 2 via the pinion shaft 3 and further rotates the ring gear 11 through the roller clutch 4 and the pinion 5 to start the internal combustion engine. When the current flow to the hollow cylindrical coil 14 is interrupted after starting the internal combustion engine, through the action of the contact return spring 26, the plunger return spring 27 as well as the contact pressing spring 25, the plunger 7, the shaft 18 and the insulative spring stopper member 22 are for the first time returned, and successively the movable plate contact 19, the shift lever 9, the roller clutch 4 and the pinion 5 are returned, thereby, the movable plate contact 19 is opened from the B stationary contact 20 and the M stationary contact 21 to stop the rotation of the starter motor 1.

As has been explained above, the assembly body including such as the shaft 18 and the movable plate contact 19 is assembled in such a manner that the movable plate contact 19 contacting the collar 18*a* formed integral with the shaft 18 and the contact pressing coil spring 25 are held by the insulative spring stopper member 22 inserted in the axial direction of the shaft 18, the number of parts for the assembly body is minimized. Further, since the cylindrical portion 22*a* of the insulative spring stopper member 22 is arranged concentrically with the contact pressing spring 25 in an overlapping manner, the axial length of the assembly body is also minimized. Still further, since the insulative spring stopper member 22 is assembled onto the shaft 18 in such a manner that the insulative spring stopper member 22 is inserted in the axial direction into the shaft 18, the diameter of the inwardly protruding step 22*c* of the insulative spring stopper member 22 is expanded at the tapered shoulder 18*d* up to that of the large diameter portion 18*c* by means of the plurality of the slits 22*b* formed on the cylindrical portion 22*a* for increasing the flexibility thereof and is moved to the small diameter portion 18*b* to fit the step thereinto to complete the assembly, which unnecessitates parts accuracy and simplifies the assembly process. During the assembly, the contact pressing coil spring 25 is of course already disposed around the outer circumference of the cylindrical portion 22*a* of the insulative spring stopper member 22, however, as mentioned previously, the gap G between the diameter of the outer circumference of the cylindrical portion 22*a* and the inner diameter of the contact pressing coil spring 25 is set so as not to contact the outer circumference of the cylindrical portion 22*a* to the inner diameter portion of the contact pressing coil spring 25, when the inwardly protruding step 22*c* passes the large diameter portion 18*c* while the diameter thereof being expanded.

When there is a clearance between the hollow cylindrical coil 14 and the magnetic core such as the casing 15 and the side plate 17 accommodating the hollow cylindrical coil 14, the hollow cylindrical coil 14 is excited by vibrations due to the internal combustion engine and lead out wires thereof are likely disconnected. According to the present invention, in order to eliminate such clearance and instead of the conventional provision of leaf springs, a taper 17*b*, for example about 10°~12°, is provided at the outer circumference of the protrusion 17*a* for the side core plate 17 and the bobbin 13 is pushed inwardly to fixedly secure the same. Since the top end outer diameter of the tapered protrusion 17*a* is set smaller than the inner diameter of the bobbin 13, the bobbin 13 is easily inserted and thereafter firmly and immovably secured at the tapered portion 17*b*, in that one of the side faces of the hollow cylindrical coil 14 is closely contacted to the side plate 16 of the casing 15 and the other face of the hollow cylinder coil 14 is closely secured onto the tapered portion 17*b* of the protrusion 17*a* while remaining a clearance from the side face of the side core plate 17. Thereby, the hollow cylindrical coil 14 is immovably secured in the space defined by the casing 15 and the side core plate 17 having the protrusion 17*a*.

When a current is flown into the hollow cylindrical coil 14, the starter motor 1 is activated. When the current flow to the hollow cylindrical coil 14 is interrupted after starting the internal combustion engine through the activation of the starter motor 1, the pull-in force of the plunger 7 disappears, thereby, the movable plate contact 19 is separated from the B stationary contact 20 and the M stationary contact 21 through the action of such as the plunger return spring 27 and the contact return spring 26. During this separation stroke the contact pressing coil spring 25 restores to the original state by moving the over travelling distance corresponding to the gap between the collar 18*a* formed integral with the shaft 18 and the movable plate contact 19, thereby, the impact return force due to the contact return coil spring 25 is applied onto the collar 18*a* formed integral with the shaft 18.

Figure 5:
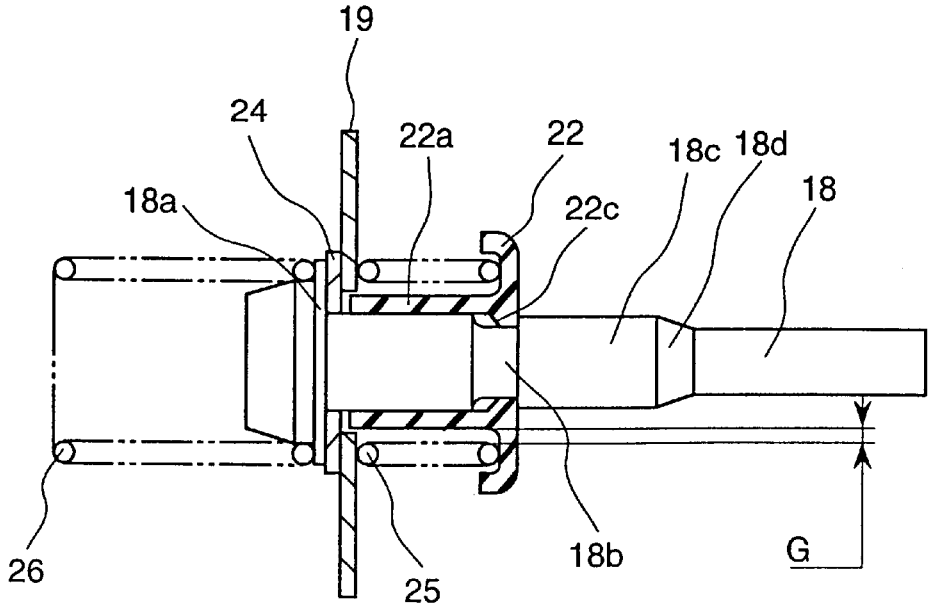
FIG. 5 is a partly cross sectioned side view of a movable contact plate assembly for an electrically conductive shaft used in a magnetic switch representing another embodiment according to the present invention.

FIG. 5 shows a cross sectional view of an assembly of a plate shaped movable contact 19 for an electrically conductive shaft 18 representing another embodiment according to the present invention. Since an insulative washer 24 is disposed between the collar 18*a* formed integral with the shaft 18 of an electrically conductive material and the plate shaped movable contact 19, the plate shaped movable contact 19 and the contact pressing coil spring 25 are electrically insulated with respect to the electrically conductive shaft 18 through the provision of the insulative spring stopper member 22 and the insulative washer 24.

Figure 6:
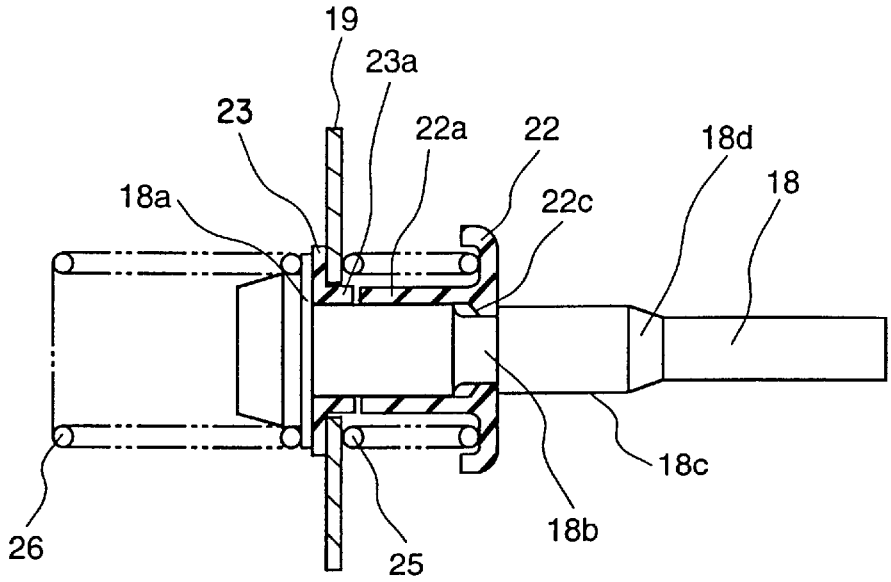
FIG. 6 is a partly cross sectioned side view of a movable contact plate assembly for an electrically conductive shaft used in a magnetic switch representing still another embodiment according to the present invention.
Figure 7:
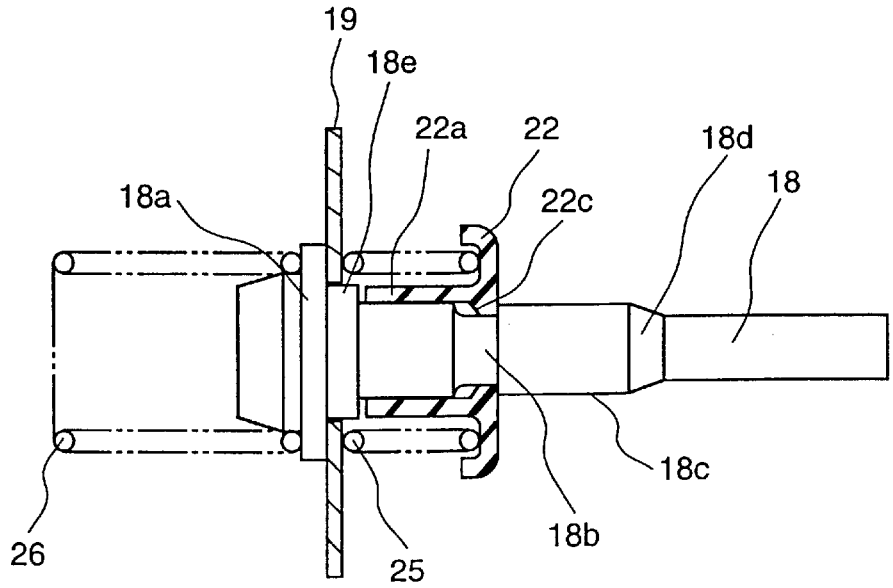
FIG. 7 is a partly cross sectioned side view of a movable contact plate assembly for an insulative shaft used in a magnetic switch representing a further embodiment according to the present invention.

FIG. 6 shows a cross sectional view of an assembly of a plate shaped movable contact 19 for an electrically conductive shaft 18 representing still another embodiment according to the present invention and FIG. 7 shows a cross sectional view of an assembly of a plate shaped movable contact 19 for an electrically insulative shaft representing a further embodiment according to the present invention. In FIG. 6, in place of the insulative washer 24 in FIG. 5 an insulative bush 23 having a cylindrical protrusion 23*a* extending through the gap between the insertion hole of the plate shaped movable contact 19 and the outer circumference of the electrically conductive shaft 18 is introduced and extends to a distance covering an over travelling distance of the shaft 18. In FIG. 7, a step 18*e* is added to the insulative shaft 18 in contrast to the embodiment as shown in FIG. 2.

In the above two embodiment, it is unnecessary to insert the top end of the cylindrical portion 22*a* of the insulative spring stopper member 22 into the gap between the insertion hole of the plate shaped movable contact 19 and the outer circumference of the shaft 18, when inserting the insulative spring stopper member 22 into the shaft 18 which facilitates forming the assembly including the shaft 18, the plate shaped movable contact 19 and the contact pressing coil spring 25.

According to the present invention, since the impact force due to the return force of the contact pressing coil spring is received by the collar formed integral with the shaft, and the contact pressing coil spring and the insulative spring stopper member are arranged concentrically with the shaft in an overlapping manner each other, a predetermined impact force enduring strength can be easily obtained and a magnetic core including the casing and the side core plates with a limited outer diameter and axial length can be realized.

Further, since the hollow cylindrical coil is sandwiched and held in both axial and radial directions by the side plate of the casing and the side core plate having the tapered protrusion, a possible movement of the hollow cylindrical coil with respect to the magnetic core including the casing and the side core plates is suppressed so as to endure a large vibration while reducing the number of parts. When an insulative shaft is used, the plate shaped movable contact and the contact pressing coil spring can be assembled together onto the insulative shaft only with the insulative spring stopper member, and when an electrically conductive shaft is used, the plate shaped movable contact and the contact pressing coil spring can be easily assembled together onto the electrically conductive shaft with the insulative spring stopper member and the insulative washer or bush. Thereby, a reliable magnetic switch with a low cost, of which structure is simplified and of which size, parts number and manufacturing steps are reduced, is realized.

What is claimed is:

1. A magnetic switch for a starter in an internal combustion engine comprising:

a hollow cylindrical coil;

a magnetic core for said hollow cylindrical coil surrounding and accommodating the same, said magnetic core includes a magnetic casing covering the outer circumference and one side face of said hollow cylindrical coil, a magnetic side plate having an inwardly protruding cylindrical portion covering the other side face of said hollow cylindrical coil, and a magnetic plunger disposed coaxially with respect to the inwardly protruding cylindrical portion of the magnetic side plate and being movable in response to excitation of said hollow cylindrical coil;

a movable non-magnetic shaft disposed coaxially with the magnetic plunger through the inwardly protruding cylindrical portion of the magnetic side plate so that a movement of the magnetic plunger is transmitted to one end of said movable non-magnetic shaft;

a plate shaped movable contact slidably fitted on said movable non-magnetic shaft;

a stopper member for the plate shaped movable contact disposed at the other end of said movable non-magnetic shaft, said stopper member is a collar formed integral with said movable non-magnetic shaft;

a contact pressing coil spring disposed concentrically with said movable non-magnetic shaft so as to press said plate shaped movable contact through one end thereof toward said stopper member;

an insulative spring stopper member fitted on said movable non-magnetic shaft which stops the other end of said contact pressing coil spring, said insulative spring stopper member includes a cylindrical portion disposed concentrically with said movable non-magnetic shaft beneath said contact pressing coil spring in an overlapping manner; and an insulative casing to be assembled with the magnetic casing including a first stationary contact to be connected to a battery and a second stationary contact to be connected to a starter motor, said first and second stationary contacts are engageably disposed with respect to said plate shaped movable contact.

2. A magnetic switch for a starter in an internal combustion engine according to claim 1, wherein said insulative spring stopper member is fitted on said movable non-magnetic shaft through an inwardly protruding step having a height A formed around the inner circumference of the cylindrical portion of said insulative spring stopper member, and further, a gap G formed between the inner diameter of said contact pressing coil spring and the outer diameter of the cylindrical portion of said insulative spring stopper member is set larger than the height A of the inwardly protruding step.

3. A magnetic switch for a starter in an internal combustion engine according to claim 1, further comprising an insulative bush disposed between said plate shaped movable contact and said collar.

4. A magnetic switch for a starter in an internal combustion engine according to claim 3, wherein said insulative bush includes an cylindrical portion extending along an annular gap formed between said movable non-magnetic shaft and an insertion hole of said plate shaped movable contact to a distance covering an over travelling distance of said movable non-magnetic shaft.

5. A magnetic switch for a starter in an internal combustion engine according to claim 1, wherein the cylindrical portion of said insulative spring stopper member is provided with a plurality of slits extending in the axial direction thereof.

6. A magnetic switch for a starter in an internal combustion engine according to claim 1, wherein said movable non-magnetic shaft is provided with a large diameter portion which registers with an insertion hole of said plate shaped movable contact.

7. A magnetic switch for a starter in an internal combustion engine comprising:

a hollow cylindrical coil;

a magnetic core for said hollow cylindrical coil surrounding and accommodating the same, said magnetic core includes a magnetic casing covering the outer circumference and one side face of said hollow cylindrical coil, a magnetic side plate having an inwardly protruding cylindrical portion covering the other side face of said hollow cylindrical coil, and a magnetic plunger disposed coaxially with respect to the inwardly protruding cylindrical portion of the magnetic side plate and being movable in response to excitation of said hollow cylindrical coil, wherein the outer circumference of the inwardly protruding cylindrical portion of the magnetic side plate is tapered in such a manner that the diameter of the top end of the tapered outer circumference of the inwardly protruding cylindrical portion is set smaller than the inner diameter of said hollow cylindrical coil so that said hollow cylindrical coil is immovably secured through the tapered outer circumference of the inwardly protruding cylindrical portion in axial and radial directions with respect to said magnetic core;

a movable non-magnetic shaft disposed coaxially with the magnetic plunger through the inwardly protruding cylindrical portion of the magnetic side plate so that a movement of the magnetic plunger is transmitted to one end of said movable non-magnetic shaft;

a plate shaped movable contact slidably fitted on said movable non-magnetic shaft;

a stopper member for the plate shaped movable contact disposed at the other end of said movable non-magnetic shaft, said stopper member is a collar formed integral with said movable non-magnetic shaft;

a contact pressing coil spring disposed concentrically with said movable non-magnetic shaft so as to press said plate shaped movable contact through one end thereof toward said stopper member;

an insulative spring stopper member fitted on said movable non-magnetic shaft which stops the other end of said contact pressing coil spring; and an insulative casing to be assembled with the magnetic casing including a first stationary contact to be connected to a battery and a second stationary contact to be connected to a starter motor, said first and second stationary contacts are engageably disposed with respect to said plate shaped movable contact.

8. A magnetic switch for a starter in an internal combustion engine according to claim 7, wherein the magnetic side plate of said magnetic core is made through a sheet metal pressing.

9. A magnetic switch for a starter in an internal combustion engine comprising:

a hollow cylindrical coil;

a magnetic core for said hollow cylindrical coil surrounding and accommodating the same, said magnetic core includes a magnetic casing covering the outer circumference and one side face of said hollow cylindrical coil, a magnetic side plate having an inwardly protruding cylindrical portion covering the other side face of said hollow cylindrical coil, and a magnetic plunger disposed coaxially with respect to the inwardly protruding cylindrical portion of the magnetic side plate and being movable in response to excitation of said hollow cylindrical coil, wherein the outer circumference of the inwardly protruding cylindrical portion of the magnetic side plate is tapered in such a manner that the diameter of the top end of the tapered outer circumference of the inwardly protruding cylindrical portion is set smaller than the inner diameter of said hollow cylindrical coil so that said hollow cylindrical coil is immovably secured through the tapered outer circumference of the inwardly protruding cylindrical portion in axial and radial directions with respect to said magnetic core;

a movable non-magnetic shaft disposed coaxially with the magnetic plunger through the inwardly protruding cylindrical portion of the magnetic side plate so that a movement of the magnetic plunger is transmitted to one end of said movable non-magnetic shaft;

a plate shaped movable contact slidably fitted on said movable non-magnetic shaft;

a stopper member for the plate shaped movable contact disposed at the other end of said movable non-magnetic shaft, said stopper member is a collar formed integral with said movable non-magnetic shaft;

a contact pressing coil spring disposed concentrically with said movable non-magnetic shaft so as to press said plate shaped movable contact through one end thereof toward said stopper member;

an insulative spring stopper member fitted on said movable non-magnetic shaft which stops the other end of said contact pressing coil spring, said insulative spring stopper member includes a cylindrical portion disposed concentrically with said movable non-magnetic shaft beneath said contact pressing coil spring in an overlapping manner; and an insulative casing to be assembled with the magnetic casing including a first stationary contact to be connected to a battery and a second stationary contact to be connected to a starter motor, said first and second stationary contacts are engageably disposed with respect to said plate shaped movable contact.

* * * * *